US007572480B2

(12) United States Patent
May et al.

(10) Patent No.: US 7,572,480 B2
(45) Date of Patent: Aug. 11, 2009

(54) METHOD OF FABRICATING A MULTILAYER CERAMIC HEATING ELEMENT

(75) Inventors: James L. May, Summerfield, OH (US); John W. Hoffman, Perrysburg, OH (US); William J. Walker, Jr., Toledo, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 214 days.

(21) Appl. No.: 11/550,968

(22) Filed: Oct. 19, 2006

(65) Prior Publication Data

US 2008/0095943 A1 Apr. 24, 2008

(51) Int. Cl.
*B05D 3/02* (2006.01)

(52) U.S. Cl. ..... 427/97.1

(58) Field of Classification Search ..... 264/139, 264/313, 635, 3.6, 603, 610, 264, 618, 269, 264/653, 665, 171.17, 171.26; 427/97.1, 427/97.9, 98.3, 98.9, 120, 126.3, 435; 118/725, 118/728; 519/542, 543; 219/542, 543
See application file for complete search history.

(56) References Cited

U.S. PATENT DOCUMENTS 3,016,897 A * 1/1962 Kendrick ..... 604/186
4,931,619 A 6/1990 Ogata et al.
5,154,785 A 10/1992 Tabata et al.
5,171,721 A * 12/1992 Nanataki et al. ..... 501/81
5,206,484 A 4/1993 Issartel
5,880,432 A 3/1999 Radmacher
5,900,201 A * 5/1999 Chatterjee et al. ..... 264/109
5,993,722 A 11/1999 Radmacher
6,036,829 A 3/2000 Yamada et al.
6,076,493 A 6/2000 Miller et al.
6,084,212 A 7/2000 Leigh
6,184,497 B1 2/2001 Leigh
6,375,692 B1 * 4/2002 Manwiller et al. ..... 51/302
6,396,028 B1 5/2002 Radmacher
6,459,072 B1 10/2002 Selmi et al.
6,610,964 B2 8/2003 Radmacher
6,744,016 B2 6/2004 Watanabe et al.
6,777,361 B2 8/2004 Aichele et al.
6,828,032 B2 12/2004 Wielstra et al.
6,855,367 B2 * 2/2005 Nakao ..... 427/58

(Continued)

OTHER PUBLICATIONS

Yu Jia, Yoshinori Kanno, Zhi-Peng Xie, New Gel-Casting Process for Alumina Ceramics Based on Gelation of Alginate, Journal for European Ceramic Society 22 (2002) p. 1911-1916.

(Continued)

*Primary Examiner*—Michael Cleveland
*Assistant Examiner*—Tabassom Tadayyon Eslami
(74) *Attorney, Agent, or Firm*—Robert L. Stearns; Dickinson Wright PLLC

(57) ABSTRACT

A multilayer ceramic structure is formed by building up a plurality of layers by sequentially coating a substrate with a series of suspensions comprising particles in a fluid medium. A composition of the sequential layers are varied to produce a structure with the desired properties. The thickness of the layers can be controlled by rheological properties of the suspension and/or by the utilization of a gelling or coagulating agent. An advantage of this method is that complete drying between the subsequent coatings is not required.

24 Claims, 3 Drawing Sheets

U.S. PATENT DOCUMENTS

| | | | | |
|---|---|---|---|---|
| 2002/0185485 | A1* | 12/2002 | Radmacher | 219/270 |
| 2003/0029856 | A1 | 2/2003 | Tatematsu et al. | |
| 2004/0070096 | A1 | 4/2004 | Grader et al. | |
| 2004/0222210 | A1 | 11/2004 | Lin et al. | |
| 2005/0145617 | A1 | 7/2005 | McMillin et al. | |

OTHER PUBLICATIONS

Isabel Santacruz, Begona Ferrari, M. Isabel Nieto, Rodrigo Moreno, Graded Ceramic Coatings Produced by Thermogelation of Polysaccharides, Elsevier, (2004) 2579-2582.

* cited by examiner

METHOD OF FABRICATING A MULTILAYER CERAMIC HEATING ELEMENT

CROSS REFERENCE TO RELATED APPLICATIONS

None.

BACKGROUND OF THE INVENTION

1. Field of the Invention

The present invention relates to methods for manufacturing ceramic heating elements.

2. Related Art

Glow plugs can be utilized in any application where a source of intense heat is required for combustion. As such, glow plugs are used as direct combustion initiators in space heaters and industrial furnaces and also as an aid in the initiation of combustion when diesel engines must be started cold. Glow plugs are also used as heaters to initiate reactions in fuel cells and to remove combustible components from exhaust systems.

With regard to the example of diesel engine applications, during starting and particularly in cold weather conditions, fuel droplets are not atomized as finely as they would be at normal running speeds, and much of the heat generated by the combustion process is lost to the cold combustion chamber walls. Consequently, some form of additional heat is necessary to aid the initiation of combustion. A glow plug, located in either the intake manifold or in the combustion chamber, is a popular method to provide added heat energy during cold start conditions.

The maximum temperature reached by a glow plug heating element is dependent on the voltage applied and the resistance properties of the components used. This is usually in the range of 1,000-1,300° C. Materials used in the construction of a glow plug are chosen to withstand the heat, to resist chemical attacks from the products of combustion and to endure the high levels of vibration and thermal cycling produced during the combustion process.

To improve performance, durability and efficiency, new materials are constantly being sought for application within glow plug assemblies. For example, specialty metals and ceramic materials have been introduced into glow plug applications. While providing many benefits, these exotic materials can be difficult to manufacture in high volume production settings. Sometimes, they are not entirely compatible with other materials, resulting in delamination and other problems. Another common problem with specialty materials manifests as tolerance variations when formed in layers resulting from cumbersome and inefficient manufacturing techniques.

Conventional methods for manufacturing ceramic heating elements, such as glow plugs, involve complex manufacturing techniques. For example, one method uses multiple layers of ceramic with different compositions. Each of those layers are built up by sequentially slip casting layers into a porous gypsum mold. The resulting part is removed from the mold and fired to produce a dense ceramic monolithic part. The casting equipment used in this type of manufacturing process is complicated and requires a complex system of pumps and hoses to inject the slurry into the molds. Moreover, the molds require careful preparation and have a very limited lifetime. Other problems exist with this method, including changes in the mold that occur after each use and result in inconsistent layer thicknesses and inconsistent performance in the fired part. Further, conventional methods are limited in their application and thickness of the layers. A thinner layer reduces the stresses associated with thermal expansion differences between layers that can result in delamination of layers during thermal cycling.

Therefore, a need exists for an improved method for manufacturing ceramic heating elements which is less complex than conventional methods and eliminates the difficulties associated with plaster molds and the slurry injection equipment. A method is needed that can build a sequence of thinner layers without compounding variations in the thickness or composition of the layers or increasing stresses associated with thermal expansion differences between the layers. It being understood that high stresses can result in delamination of the layers during the thermal cycling.

SUMMARY OF THE INVENTION

A multilayer ceramic structure is formed by building up a plurality of layers by sequentially coating a substrate with a series of suspensions comprising particles in a fluid medium. A composition of the sequential layers are varied to produce a structure with the desired properties. The thickness of the layers can be controlled by theological properties of the suspension and/or by the utilization of a gelling or coagulating agent. An advantage of this method is that complete drying between the subsequent coatings is not required.

The method provides the manufacture of multilayer ceramic heating elements such as those used for glow plugs to be automated and eliminates difficulties associated with plaster molds and the slurry injection equipment. Further, the sequential building up of thin layers produces a product that has smaller variations in thickness or composition than are possible with slip casting, injection molding or extrusion. The reduced stresses associated with thermal expansion differences between layers resists delamination of the layers during thermal cycling.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
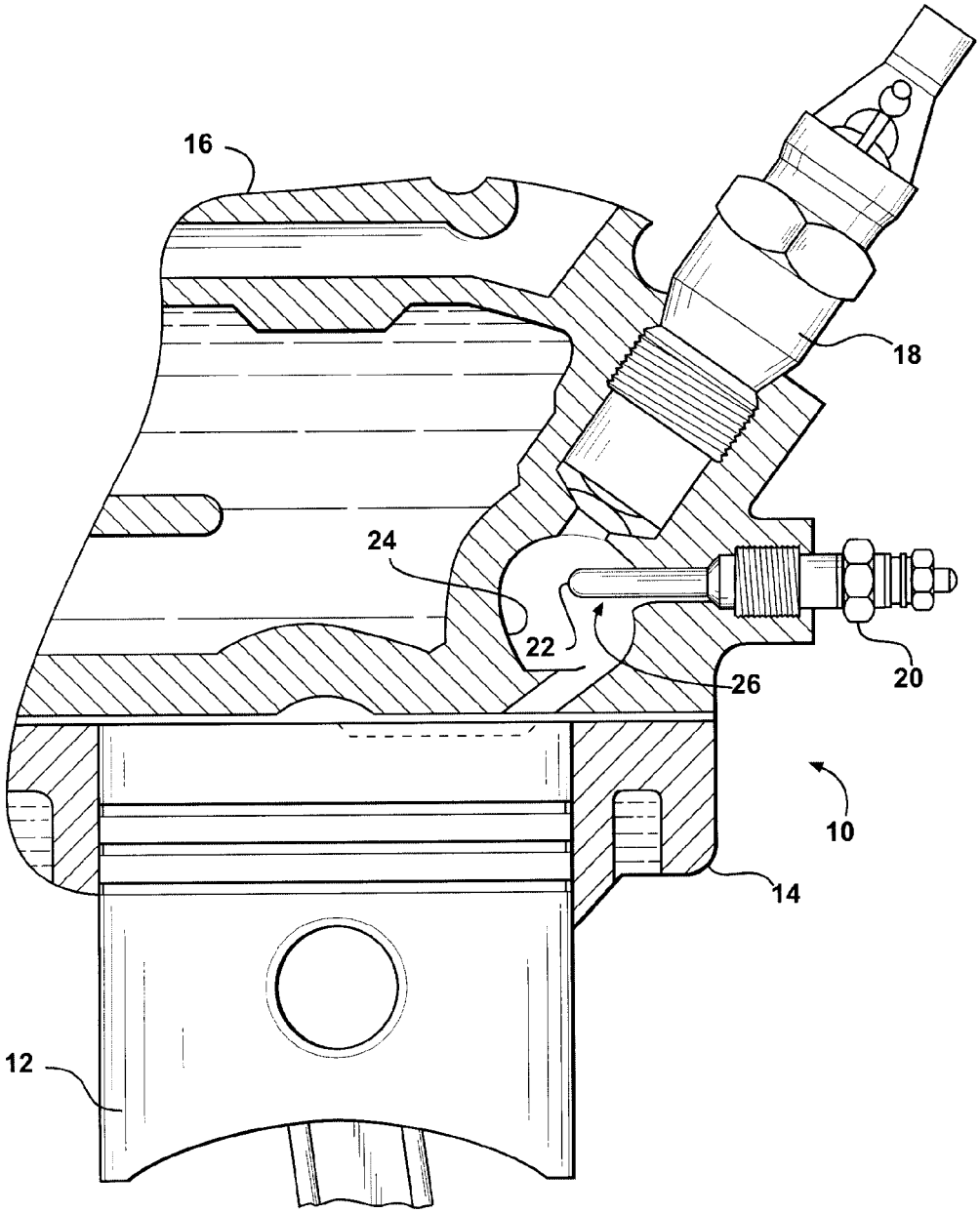
FIG. 1 is a simplified cross-sectional view of an exemplary glow plug installation in the pre-combustion chamber of a diesel engine.

Referring to the Figures, wherein like numerals indicate like or corresponding parts throughout the several views, a diesel engine is generally shown at 10 in FIG. 1. The engine 10 includes a piston 12 reciprocating in a cylinder. The cylinder is formed in a block 14. A cylinder head 16 covers the block 14 to enclose a combustion chamber. An intake manifold routes through the cylinder head 16 and includes a fuel injector 18 which, at timed intervals, delivers a charge of atomized fuel into the combustion chamber. A glow plug, generally indicated at 20, includes a high temperature tip 22 positioned, in this example, within a pre-combustion chamber 24. The arrangement of components as illustrated in FIG. 1 is typical of one configuration style for a diesel engine. However, there are many other diesel engine types for which a glow plug 20 according to the invention is equally applicable. Furthermore, many other types of devices can utilize the subject glow plug 20, such as space heaters, industrial furnaces, fuel cells, exhaust systems, and the like. Accordingly, the subject glow plug 20 is not limited to use in diesel engine applications.

Figure 2:
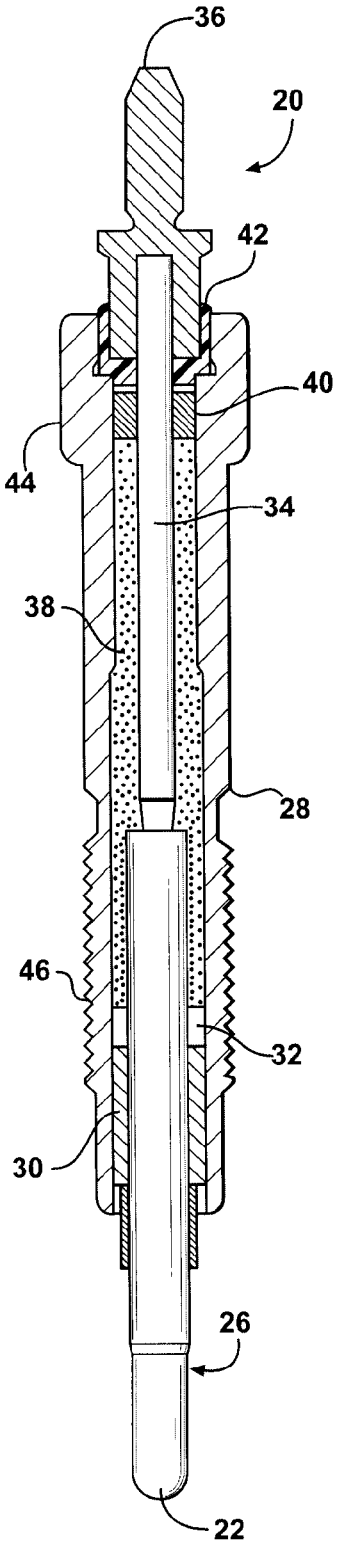
FIG. 2 is a cross-sectional view of a glow plug assembly in accordance with an embodiment of the invention.

Referring now to FIG. 2, a cross-sectional view of the glow plug 20 is depicted. Here, the high-temperature tip 22 is shown forming the distal end of a heating element, generally indicated at 26. The heating element 26 is a composite structure which protrudes from the end of a hollow shell 28, such as by a copper ring 30 and a brazed joint 32. By these means, the heating element 26 is both securely fixed in position relative to the shell 28 and held in electrically conductive relationship therewith. A proximal end of the heating element 26 is affixed to a conductive center wire 34, such as via a tapered and brazed joint. The proximal end of the center wire 34 holds a terminal 36 used to join an electrical lead (not shown) from the ignition system. The center wire 34 and terminal 36 are held in electrical isolation from the conductive shell 28 by way of an insulating layer of alumina powder 38, epoxide resin 40 and plastic gasket 42. Of course, alternative materials may be suitable to hold the center wire 34 and terminal 36 in position and in electrical isolation from the shell 28. The exterior of the shell 28 is provided with a tool fitting 44 and threads 46. Of course, the glow plug 20 can take numerous other forms and constructions, depending upon the materials used and its intended application.

Generally stated, the heating element 26 operates by passing an electrical current through a resistive material. The current is introduced to the heating element 26 through the center wire 34. Current flows through the heating element 26 and into the shell 28 which is typically metallic and grounded through the cylinder head 16 or other component of the device.

Figure 3:
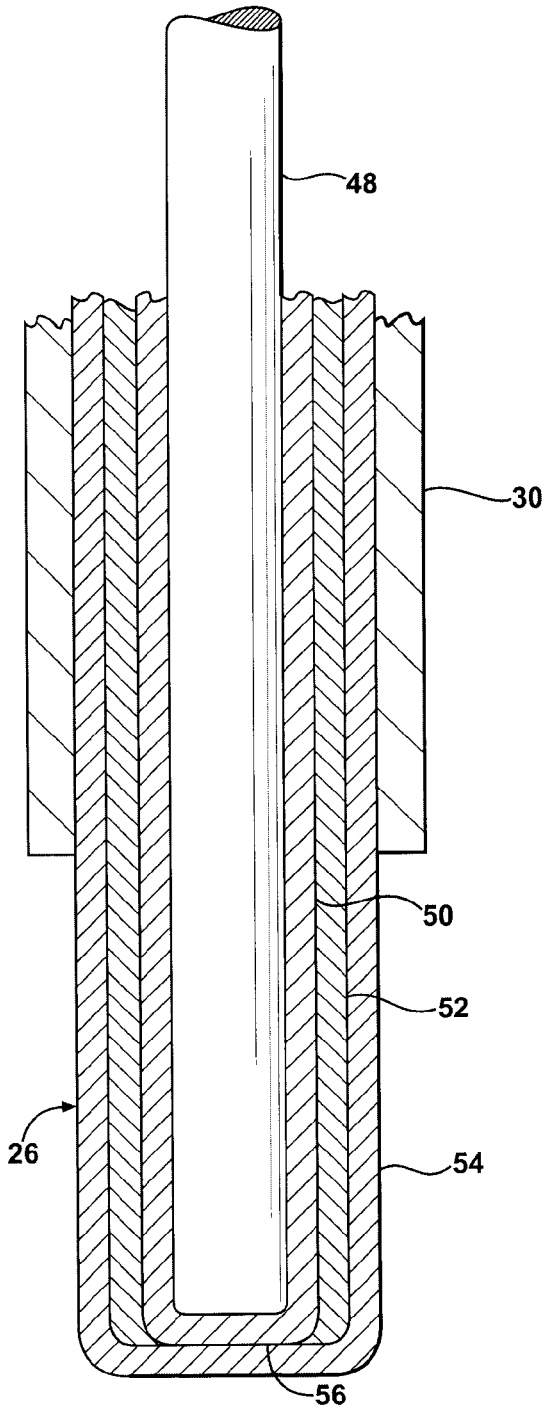
FIG. 3 is a fragmentary, cross-sectional view of the high temperature tip region of a glow plug according to one embodiment of the invention.

A fragmentary, cross-sectional view taken through the lower end of the heating element 26 is depicted in FIG. 3. Here, the heating element 26 is shown including a starter substrate 48. Starter substrate 48 is used as a foundation for forming a layered structure. Substrate 48 may be a fired or unfired ceramic, ceramic composite or metal form that will become a part of the final structure. The present invention also contemplates that substrate 48 may be a form that can be removed from the multilayer structure before it is fired. For example, substrate 48 may be a metal mandrel.

Alternatively, substrate 48 may be a pre-form that is configured to be removable by pyrolosis during heat treatment of the layered resistive core. In an embodiment of the invention, the substrate 48 has a surface treatment or a configuration that promotes the adhesion of subsequent layers as described here below.

Figure 4:
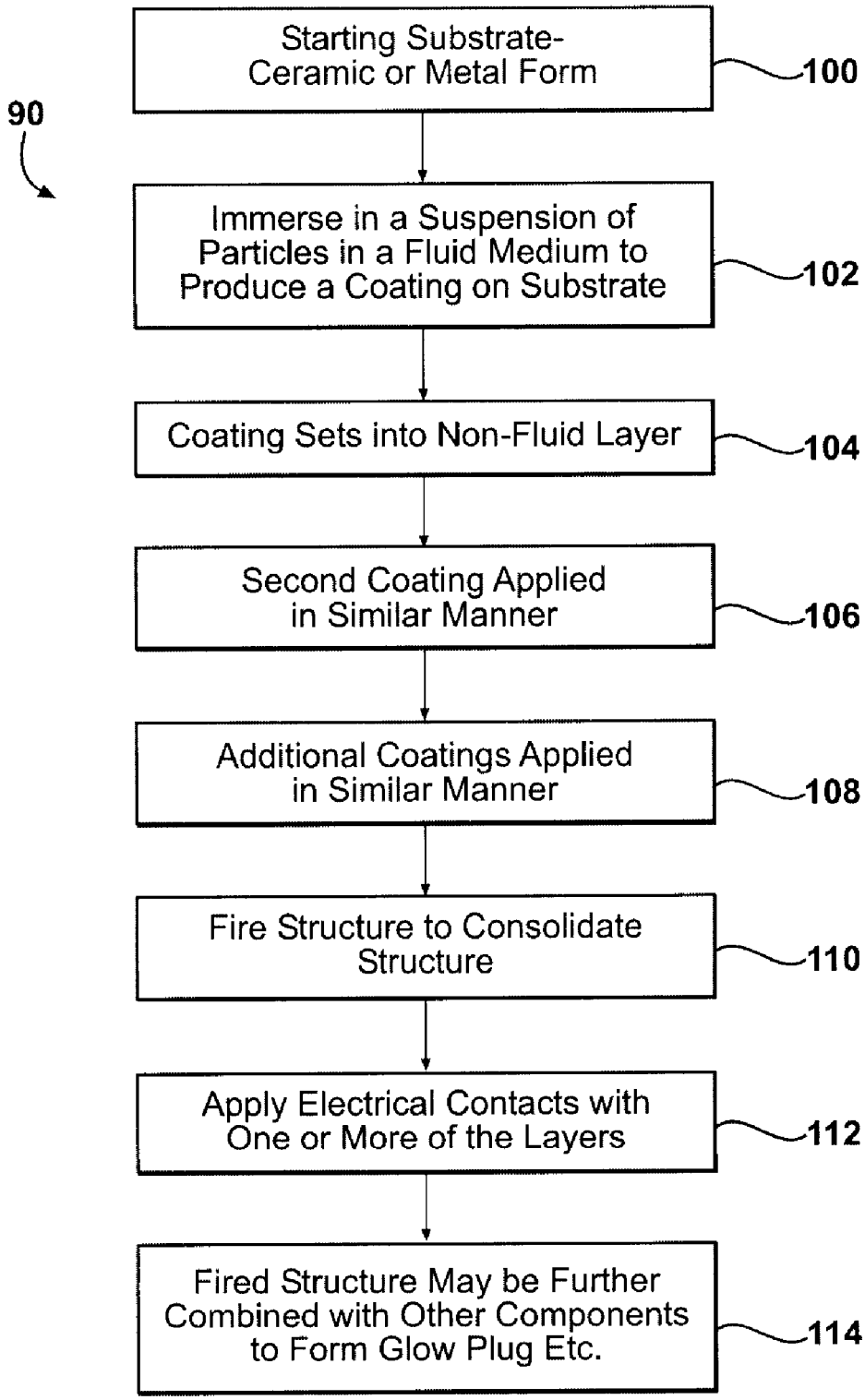
FIG. 4 is a flowchart illustrating the method for manufacturing the heating device, in accordance with an embodiment of the present invention.

With reference to both FIGS. 3 and 4, a method 90 for forming the multi-layered structure will now be described, in accordance with an embodiment of the present invention. In an initial step, as represented by block 100, a starting substrate or pre-form 48 is provided upon which the multi-layered structure will be built. At step 102, substrate 48 is immersed in a suspension of particles in a fluid medium to produce a first coating 50 (shown in FIG. 3) on substrate 48. First coating 50 is caused to set into a non-fluid layer, as represented by block 104. First coating 50 is transformed into a non-fluid layer by chemical or physical means. At block 106, second coating 52 is applied over first coating 50 in a similar manner. The present invention contemplates that second coating 52 has the same composition or a different composition relative to first coating 50. Additional coatings such as third coating 54 are sequentially applied until the desired multi-layer structure is completed, as represented by block 108. There may be additional coatings or layers over the third coating 54. In some applications, it may be desirable to modify one or more of the coating layers 50, 52, 54 to provide for an electrical interconnect. For example, as illustrated in FIG. 3, the tip of the second coating 52 may be ground flat so that the first 50 and third 54 coating layers can establish an electrical connection therebetween. Once any such optional modifications have been made, and all desired layers built, the assembly is fired to consolidate the multilayered structure, as represented by block 110. The multi-layered structure may be further treated before or after firing to provide electrical contacts with one or more of the various layers, as represented by block 112. As shown in FIG. 3, this electrical contact may be established between the first 50 and third 54 coatings. The fired structure may be further combined with other components to form a device such as a glow plug 20 to be used in a diesel engine 10, as represented by block 114.

In an embodiment of the present invention, first coating 50 is a suspension of ceramic particles in a water that also contains a gelling binder such as alginate. After the layer is formed, the alginate-containing suspension can be caused to set by immersing the coated pre-form in a solution containing dissolved calcium ions. The calcium ions chemically interact with the alginate causing the suspension to gel. Once the coating has gelled it may be desirable to wash the surface to remove excess gelling agent before forming the next layer. Alternatively, the substrate might be first coated with a calcium-containing solution and then subsequently dipped into alginate-containing slurry to form a gelled layer. The thickness of the layer is controlled by the amount of calcium in the calcium-containing solution.

In yet another embodiment of the present invention, other gellation reactions as an alternative to alginate and calcium may be used. For example, a slurry containing polyacrylic acid can be gelled by changing the pH or the temperature of the slurry. In operation, the substrate 48 is coated by dipping the substrate 48 into a slurry of particles that contain polyacrylic acid. The coating is then gelled either by dipping the coated substrate 48 into an acidic or basic solution depending on the type of polyacrylic acid used or by dipping it into a bath containing an immiscible liquid. The immiscible liquid is held at an elevated temperature, which causes gellation.

Alternatively, an organic monomer may be used as a gelling agent in a suspension of ceramic particles. The organic monomer is coated on substrate 48 and gelled by polymerization initiated by a chemical initiator. Other types of binders could be gelled by ultraviolet radiation. A large number of gellation binder systems are known in the ceramic art and any of these could be used in this method.

Any one of the layers might also be modified in such a way as to form interconnects between layers. For example, in a three layer structure a first conductive layer might be formed followed by an insulating layer and finally a resistive layer. After the insulating layer is formed, a portion of the insulating layer is removed exposing the conductive layer and forming an electrical contact between the conductive layer and the resistive layer during a final coating operation.

In a manufacturing setting the method of the present invention is performed, for example, by setting up a series of slurry tanks and solution tanks in a line with the substrates suspended above the tanks on a moving conveyor. Alternately, the substrates may be dipped and then set or hung on draining racks to drain and then moved to the next tank to be dipped and drained. This process is repeated until the desired coatings have been built up on the substrate 48.

In yet another embodiment of the invention, a method is provided whereby the substrate 48 is sprayed to create the coating layers prior to the gellation step. The gellation of these coating layers may also be accomplished by spraying any of the gelling solutions described above instead of dipping the substrate. The addition of subsequent coatings allows individual conductors, resistors and insulators to be merged into one another gradually to reduce thermal shock and delamination. More specifically, the layers may be designed by slurry rheology to produce thicknesses of 0.001 inch (i.e., about 25 microns) after dipping. Thus, the difficulty of injection molding plaster casting (and other methods) is eliminated and makes the process easy to semi-automate into high volume production.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A method for manufacturing a ceramic heating element having a plurality of layers, the method comprising:

providing a starter substrate;

immersing the starter substrate in a first suspension of particles in a fluid medium to form a first layer;

activating the first layer to cause the first layer to set into a non-fluid layer;

immersing the starter substrate having the activated first layer in a second suspension of particles in a fluid medium to form a second layer over the activated first layer;

activating the second layer to cause the second layer to set into a non-fluid layer;

removing the starter substrate from the activated first layer;

firing the activated first and second layers to consolidate the layers into a monolithic multilayered structure; and connecting electrical elements to at least one of the first and second layers.

2. The method of claim 1 wherein immersing the starter substrate further includes immersing the starter substrate in an aqueous suspension of ceramic particles which also contains a gelling binder.

3. The method of claim 2 wherein the gelling binder is alginate.

4. The method of claim 1 wherein immersing the starter substrate further includes immersing the starter substrate in a solution having dissolved calcium ions.

5. The method of claim 1 further comprising washing the surface of the gelled layer to remove excess calcium ions.

6. The method of claim 1 further including coating the starter substrate with a calcium material and then dipping the calcium-coated substrate in an alginate containing slurry.

7. The method of claim 6 further including varying the amount of calcium in the calcium material to vary the coating thickness of the layer.

8. The method of claim 1 wherein the immersing step includes immersing the substrate in a gelling binder containing polyacrylic acid.

9. The method of claim 8 wherein the polyacrylic acid binder is activated by immersing in an acid or base solution that changes the pH of the layer.

10. The method of claim 9 further including the step of washing the surface of the layer to remove excess activating solution.

11. The method of claim 1 further including the step of immersing the starter substrate having the activated first and second layers in a third suspension of particles in a fluid medium to form a third layer prior to said firing step.

12. The method of claim 11 further including the step of electrically connecting at least two of the three layers to one another.

13. A method for manufacturing a ceramic heating element having a plurality of layers, the method comprising:

providing a starter substrate;

immersing the starter substrate in a first suspension of particles in a fluid medium to form a first layer;

activating the first layer to cause the first layer to set into a non-fluid layer;

immersing the starter substrate having the activated first layer in a second suspension of particles in a fluid medium to form a second layer;

firing the starter substrate with the plurality of layers to consolidate the layers into a monolithic multilayered structure while the starter substrate disintegrates; and connecting electrical elements to at least one of the first and second layers.

14. The method of claim 13 wherein immersing the starter substrate further includes immersing the starter substrate in an aqueous suspension of ceramic particles which also contains a gelling binder.

15. The method of claim 14 wherein the gelling binder is alginate.

16. The method of claim 13 wherein immersing the starter substrate further includes immersing the starter substrate in a solution having dissolved calcium ions.

17. The method of claim 13 further comprising washing the surface of the gelled layer to remove excess calcium ions.

18. The method of claim 13 further including coating the starter substrate with a calcium material and then dipping the calcium-coated substrate in an alginate containing slurry.

19. The method of claim 18 further including varying the amount of calcium in the calcium material to vary the coating thickness of the layer.

20. The method of claim 13 wherein the immersing step includes immersing the substrate in a gelling binder containing polyacrylic acid.

21. The method of claim 20 wherein the polyacrylic acid binder is activated by immersing in an acid or base solution that changes the pH of the layer.

22. The method of claim 21 further including the step of washing the surface of the layer to remove excess activating solution.

23. The method of claim 13 further including the step of immersing the starter substrate having the activated first and second layers in a third suspension of particles in a fluid medium to form a third layer prior to said firing step.

24. The method of claim 23 further including the step of electrically connecting at least two of the three layers to one another.

* * * * *